US006634173B2

(12) United States Patent
Linster et al.

(10) Patent No.: US 6,634,173 B2
(45) Date of Patent: Oct. 21, 2003

(54) HYDRAULIC RESCUE SYSTEM

(75) Inventors: Robert J. Linster, North Wales, PA (US); Frank Sclafani, Jr., Jeffersonville, PA (US)

(73) Assignee: Hale Products, Inc., Conshohocken, PA (US)

( * ) Notice: Subject to any disclaimer, the term of this patent is extended or adjusted under 35 U.S.C. 154(b) by 162 days.

(21) Appl. No.: 10/044,085

(22) Filed: Oct. 22, 2001

(65) Prior Publication Data

US 2003/0074896 A1 Apr. 24, 2003

(51) Int. Cl.[7] ..... F16D 3/02
(52) U.S. Cl. ..... 60/484; 60/486
(58) Field of Search ..... 60/484, 486; 74/11; 180/53.4

(56) References Cited

U.S. PATENT DOCUMENTS

| | | | | |
|---|---|---|---|---|
| 4,721,029 | A | 1/1988 | Hoffman et al. | |
| 4,951,709 | A | 8/1990 | Kirkham | |
| 5,125,158 | A | 6/1992 | Casebolt et al. | |
| 5,190,250 | A | 3/1993 | DeLong et al. | |
| 5,477,680 | A | 12/1995 | Heskey et al. | |
| 5,605,173 | A | 2/1997 | Arnaud | |
| 5,622,353 | A | 4/1997 | Painter et al. | |
| 5,678,982 | A * | 10/1997 | Schwaiger | 60/486 |
| 5,884,664 | A | 3/1999 | Nagai et al. | |
| 5,927,337 | A | 7/1999 | LaMantia | |
| 6,000,680 | A | 12/1999 | Kimura et al. | |
| 6,179,001 | B1 | 1/2001 | Schutz | |
| 6,394,206 | B1 * | 5/2002 | Fury | 74/15.86 |
| 2001/0003289 | A1 | 6/2001 | Mead et al. | |
| 2001/0022199 | A1 | 9/2001 | Tokunaga et al. | |

OTHER PUBLICATIONS

"Rescue heroes born of hydraulics and adrenaline", HURST Jaws of Life® *Rescue Systems Product Catalog*, ©1997 Hale Products, Inc., bulletin 648, Jan. 1998, 24 pp.
Brochure: "New! XRT PTO Powerhouse®—Guaranteed to GO every time you GO.", XRT Power Systems, Marblehead, MA 01945, 1 page, www.xrtcombi.com.
XRT PTO "Press Release: XRT Power Systems Rescue Power is now available in PTO Drive for Ford Super Duty Series with 4R100 Transmissions.", Sep. 27, 2001, 2 pages, http://www.hansenmarine.com/xrtpto.htm.
XRT Combi Home, "Welcome to XRTCOMBI.COM", Sep. 27, 2001, 3 pages, http://www.hansenmarine.com/xrtcombi.htm.
Advertisement: "XRT® Hydraulic Pump—Power Take Off For Ford E&F 550's with 4R100 Automatic 2&4 WD Transmissions", 1 page.

* cited by examiner

*Primary Examiner*—Edward K. Look
*Assistant Examiner*—Igor Kershteyn
(74) *Attorney, Agent, or Firm*—Akin Gump Strauss Hauer & Feld, L.L.P.

(57) ABSTRACT

A hydraulic rescue system comprises a fluid reservoir, a pump assembly having a plurality of pump modules, and a manifold assembly having a corresponding number of manifold modules. Each pump module includes an input port for drawing hydraulic fluid from the fluid reservoir and an output port for supplying hydraulic fluid under pressure to a hydraulic rescue tool. Each manifold module includes a fluid circuit that is adapted to fluidly connect the output port of one of the pump modules with a hydraulic rescue tool. A PTO adapter is connected to the pump assembly and is operably connectable to a PTO shaft of a vehicle transmission for operating the pump modules. In this manner, a number of different hydraulic rescue tools can be operated simultaneously with full pressure from the pump assembly.

25 Claims, 12 Drawing Sheets

HYDRAULIC RESCUE SYSTEM

BACKGROUND OF THE INVENTION

This invention relates to emergency rescue equipment, and more particularly to a hydraulic rescue system for operating a plurality of rescue tools.

Portable rescue tools are often used under emergency conditions, such as at the scene of an automobile accident, where rescue personnel must operate with care and often very quickly to reach trapped victims and extricate them for medical treatment. During extrication, it is often necessary to employ a plurality of rescue tools, such as spreaders, cutters, rams, grabbers, jacks, and the like. The rescue tools typically include a piston that moves under hydraulic fluid pressure between retracted and extended positions. The hydraulic fluid is typically supplied under pressure by a hydraulic pump which can be located on the rescue vehicle and connected to the tool through a hydraulic supply line. Fluid is returned to the pump supply reservoir through a hydraulic return line. The rescue tools often must be used at a location remote from the pump. Accordingly, the hydraulic supply and return lines may extend over a substantial distance.

By way of example, U.S. Pat. No. 4,721,029 issued to Hoffman et al., the disclosure of which is hereby incorporated by reference, describes a pressurized hydraulic fluid system that is arranged to supply hydraulic fluid to two or three rescue tools from a hydraulic pump through a series flow connector block. In this manner, two or three tools can be operated simultaneously. However, when it is desired for example to run only one or two rescue tools, the remaining ports on the connector block must be connected together through one or more jumper hoses. This can be time consuming and inconvenient, especially in situations requiring quick rescue efforts. The provision of a series connection also limits the amount of rescue tools that can be used.

BRIEF SUMMARY OF THE INVENTION

According to the invention, a hydraulic rescue system for a vehicle having a transmission with a PTO shaft is provided. The hydraulic rescue system comprises a fluid reservoir and a pump assembly fluidly connected to the fluid reservoir. The pump assembly has at least one pump module with an input port for drawing hydraulic fluid from the fluid reservoir and at least one output port for supplying hydraulic fluid under pressure to at least one hydraulic rescue tool. A PTO adapter is operably connected to the at least one pump module and is operably connectable to the PTO shaft of the vehicle transmission for operating the at least one pump module.

Further according to the invention, a hydraulic rescue system comprises a fluid reservoir, a pump assembly having a plurality of pump modules, and a manifold assembly having a corresponding number of manifold modules. Each pump module includes an input port for drawing hydraulic fluid from the fluid reservoir and a first output port for supplying hydraulic fluid under pressure to a hydraulic rescue tool. Each manifold module includes a first fluid circuit that is adapted to fluidly connect the first output port of one of the pump modules with a hydraulic rescue tool.

Further according to the invention, a hydraulic rescue system comprises a fluid reservoir, a pump assembly having at least one pump module with an input port for drawing hydraulic fluid from the fluid reservoir and an output port for supplying hydraulic fluid under pressure to a hydraulic rescue tool, and a manifold assembly. The manifold assembly comprises at least one manifold module with a fluid circuit that is adapted to fluidly connect the output port of the pump module with a hydraulic rescue tool, and a valve located in the fluid circuit. The valve is movable to a first position to direct the hydraulic fluid under pressure from the output port to the hydraulic rescue tool when the at least one hydraulic rescue tool is in operation. The valve is also movable to a second position to direct the hydraulic fluid from the at least one output port to the fluid reservoir when the hydraulic rescue tool is inactive.

BRIEF DESCRIPTION OF THE SEVERAL VIEWS OF THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
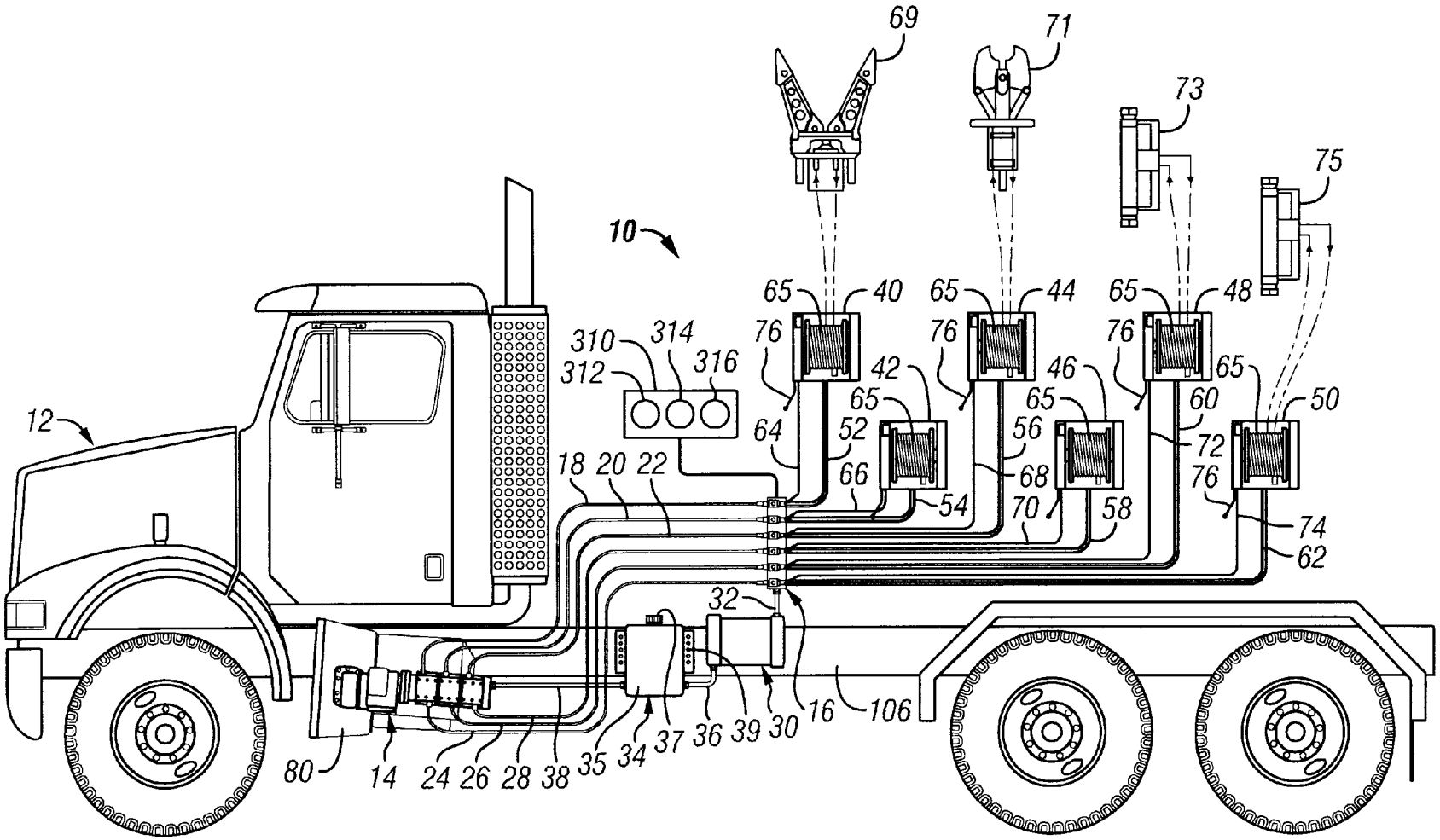
FIG. 1 is a diagrammatic illustration of a hydraulic rescue system in accordance with an exemplary embodiment of the invention mounted to a vehicle.

Referring now to the drawings, and to FIG. 1 in particular, a hydraulic rescue system 10 according to an exemplary embodiment of the present invention is illustrated. The hydraulic rescue system is adapted for mounting on a vehicle 12, such as a rescue vehicle. The hydraulic rescue system 10 comprises a pump assembly 14, a manifold assembly 16 fluidly connected to the pump assembly 14 through hydraulic supply lines 18, 20, 22, 24, 26, and 28, a fluid cooler 30 connected to the manifold assembly 16 through a first hydraulic return line 32, and a fluid reservoir 34 connected to the fluid cooler 30 through a second hydraulic return line 36. The fluid reservoir 34 is in turn connected to the pump assembly 14 through a hydraulic suction line 38. As shown, a plurality of hydraulic hose reels 40, 42, 44, 46, 48, and 50 are preferably separately fluidly connected to the manifold assembly 16 through a plurality of hydraulic dual feed/return lines 52, 54, 56, 58, 60, and 62, respectively. Each hydraulic hose reel 40–50 carries a dual feed/return hose 65 for supplying pressurized hydraulic fluid to a separate emergency rescue tool, such as tools 69, 71, 73, and 75 that may be associated with each of the hydraulic hose reels. Preferably, each emergency rescue tool is operated independently of the other emergency rescue tools, as will be described in greater detail below. Such emergency rescue tools can include, but are not limited to, rams, cutters, spreaders, grabbers, jacks, combination tools, and so on. Electrical control lines 64, 66, 68, 70, 72, and 74 extend between the manifold 16 and the hydraulic hose reels 40, 42, 44, 46, 48, and 50, respectively, for selectively applying hydraulic pressure to the emergency rescue tools. An electrical switch (not shown) on each hose reel can be actuated and de-actuated for controlling operation of the manifold assembly 16, as will be described in greater detail below. When the hydraulic hose reels are motorized, a control lever or switch 76 can be provided on each reel for winding each hose 65. Although hose reels are preferred, it will be understood that the emergency rescue tools can be directly connected to the manifold assembly 16 through separate hydraulic hoses.

The fluid cooler 30 is of conventional construction and can include coiled tubing (not shown) through which the hydraulic fluid passes, cooling fins (not shown) associated with the coiled tubing, and a fan (not shown) for blowing air over the coiled tubing and cooling fins.

The fluid reservoir 34 is also of conventional construction and includes a tank 35, a fluid fill cap 37, and a mounting bracket 39 for connecting the fluid reservoir to the frame 106 of the vehicle 12.

The pump assembly 14 is preferably connected to the power take-off (PTO) shaft of the vehicle's transmission 80. It will be understood, however, that power to the pump assembly 14 can be provided by electric motors, combustion engines, and other pump driving means.

Figure 2:
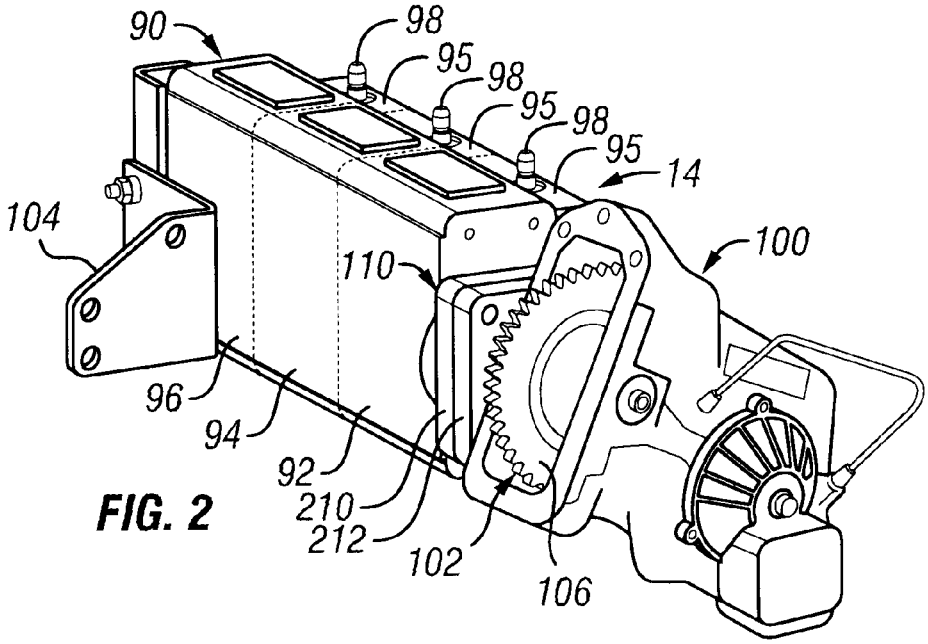
FIG. 2 is a front isometric view of a hydraulic pump assembly that forms part of the hydraulic rescue system of FIG. 1.
Figure 3:
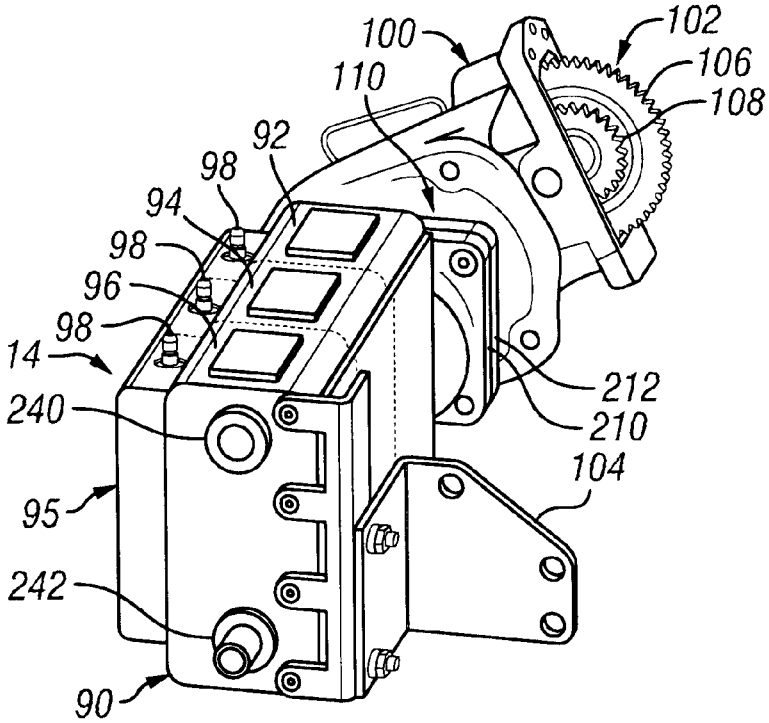
FIG. 3 is a rear isometric view of the hydraulic pump assembly.

With additional reference to FIGS. 2 and 3, the pump assembly 14 includes a pump housing 90 that is preferably divided into three pump modules 92, 94, and 96, as represented by dashed line, with each module having a pressure plate 95 with a pair of oppositely disposed hydraulic fittings 98 and 99 (FIG. 8) for connection to two of the hydraulic supply lines 18–28, as will be described in greater detail below. In this manner, each module can supply fluid under pressure to two separate emergency rescue tools. It will be understood that more or less fittings can be provided on each module for operating more or less emergency rescue tools.

The pump housing 90 is in turn preferably connected to a drive housing 100 that mounts the pump assembly to the transmission 80 and connects the PTO shaft of the transmission to the pump assembly 14 through a reduction gear assembly 102 mounted for rotation in the drive housing 100. The reduction gear assembly 102 includes a first gear 106 that is adapted to engage a gear of the PTO shaft (not shown) and a second smaller gear 108 that is keyed or otherwise connected for rotational movement with the first gear 106. A mounting bracket 104 can be provided on the pump housing 90 for mounting the pump assembly 14 to the transmission 80 (FIG. 1) of the vehicle 12.

Although a particular configuration for the pump assembly 14 is shown, it will be understood that the shape and size of the housings 90, 100, the shape and size of any mounting brackets, as well as the particular configuration of the reduction gear assembly 102, can greatly vary depending on the vehicle and transmission types.

Figure 4:
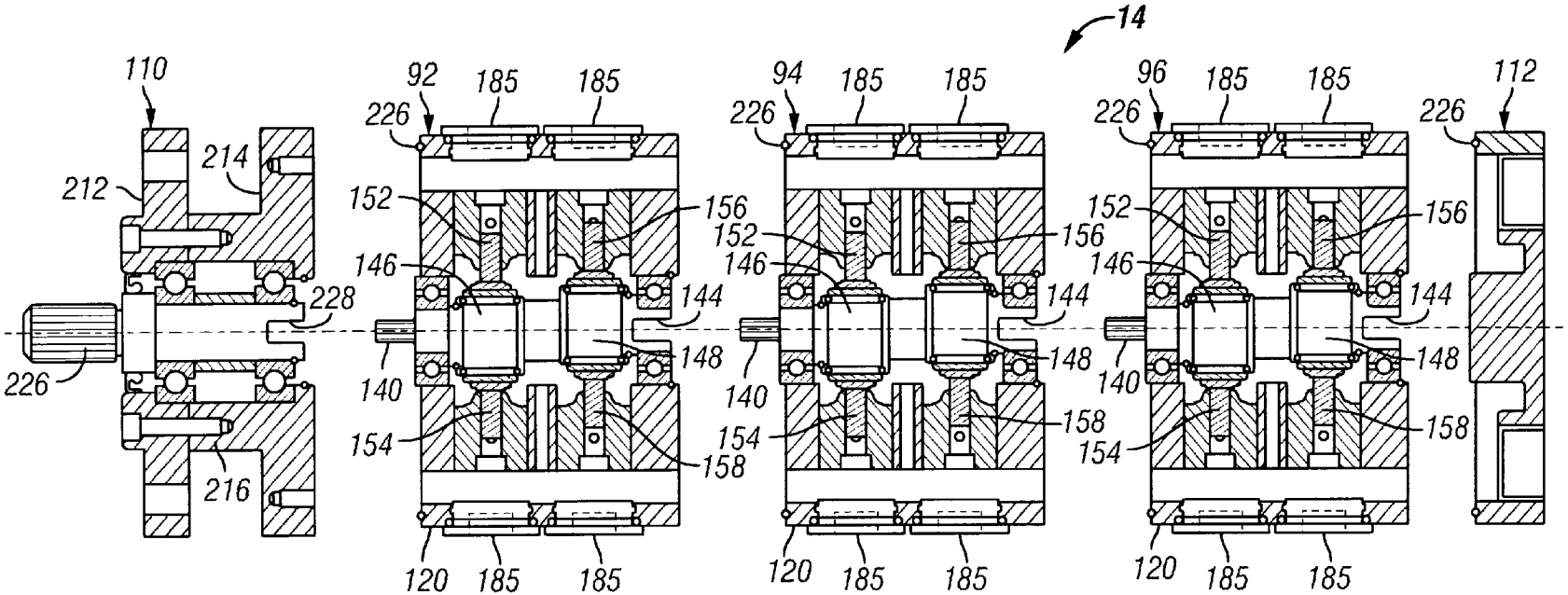
FIG. 4 is a side sectional view of the hydraulic pump assembly.
Figure 5:
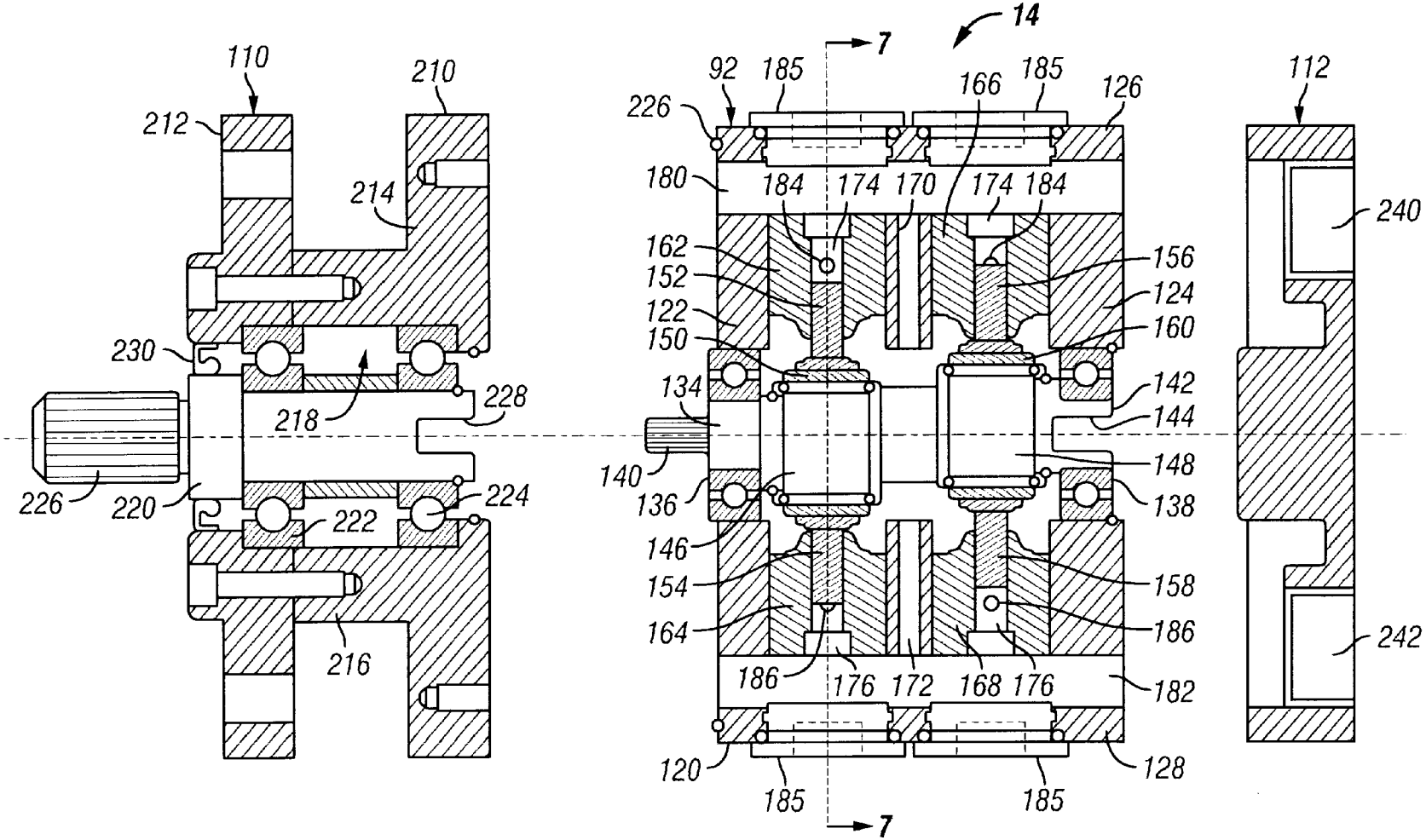
FIG. 5 is a side sectional view of a hydraulic pump assembly with a single pump module in accordance with an exemplary embodiment of the invention.
Figure 6:
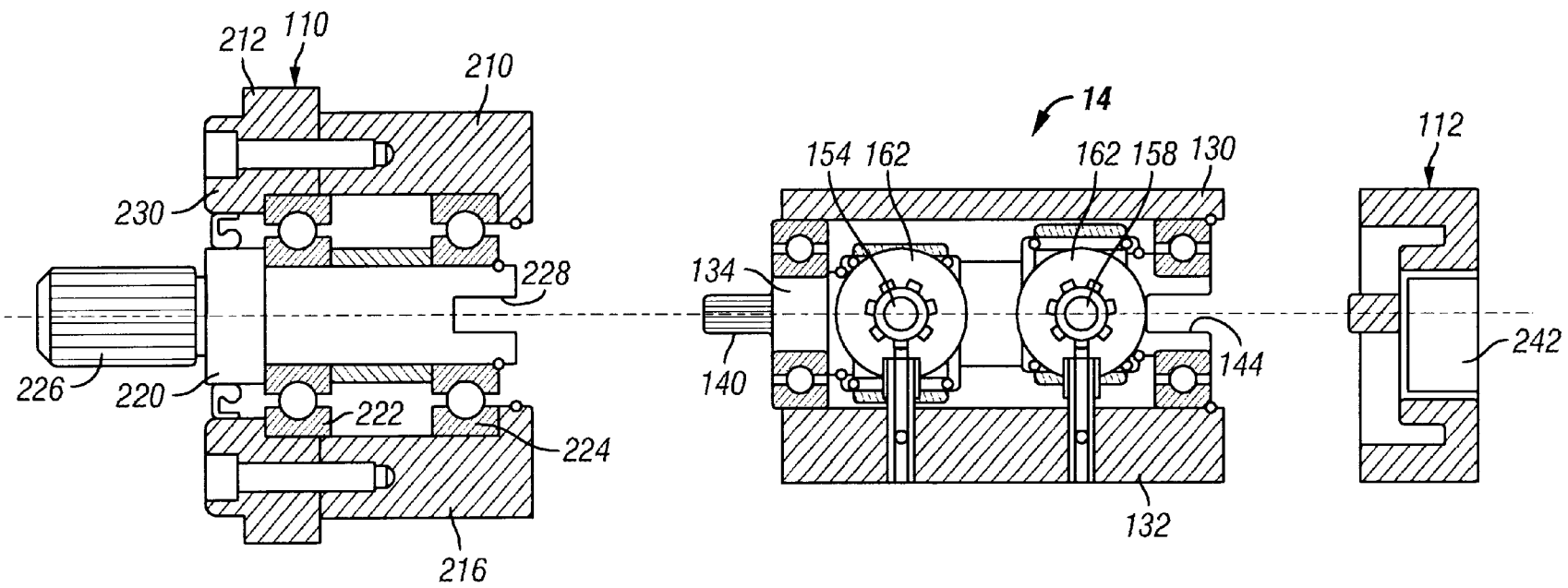
FIG. 6 is a top sectional view of the hydraulic pump assembly with the single pump module.
Figure 14:
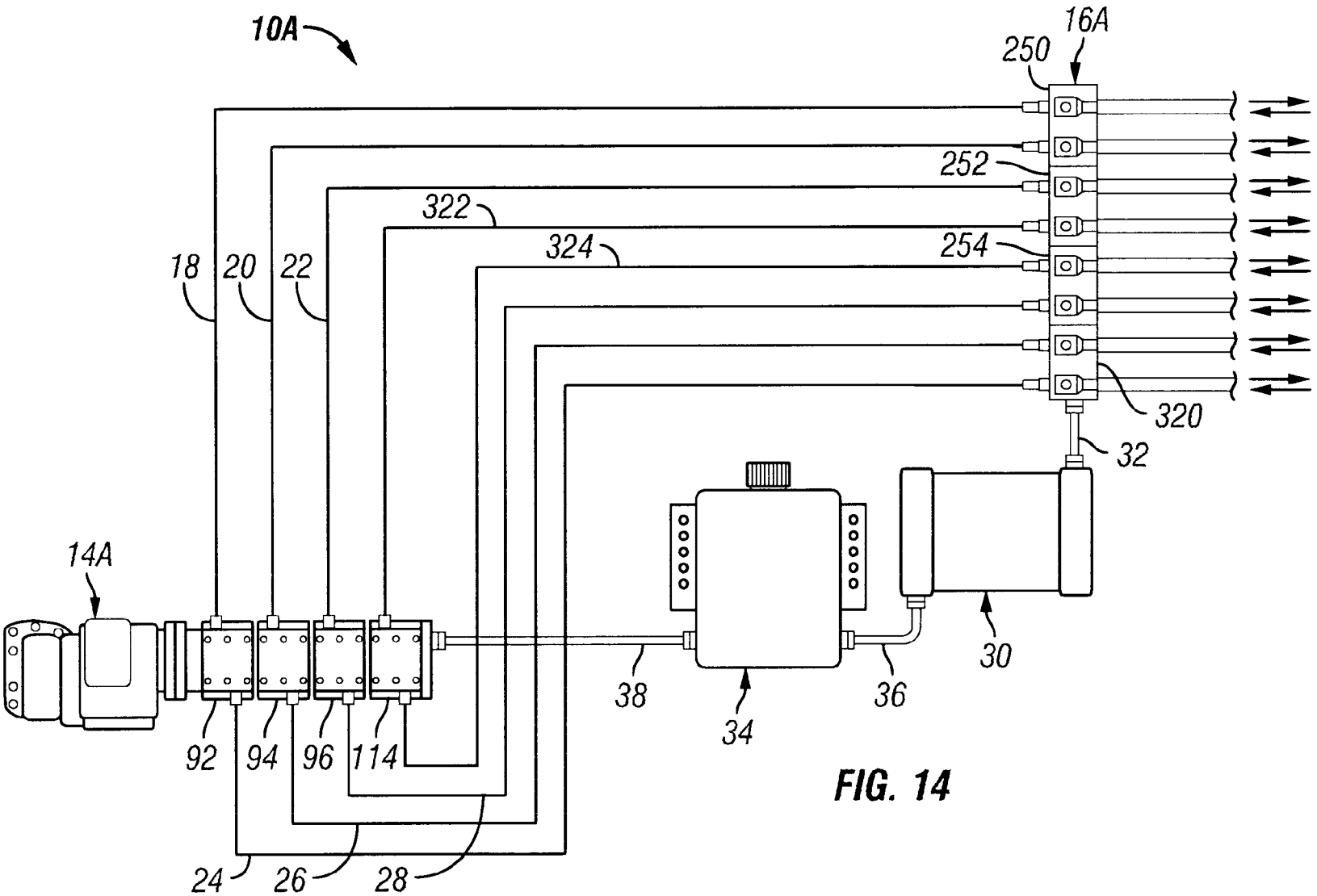
FIG. 14 is a diagrammatic illustration of a hydraulic rescue system in accordance with a further embodiment of the invention.

With reference now to FIGS. 4–7, the pump modules 92, 94 and 96 are positioned between a PTO adapter 110 and an end plate 112. The pump modules 92, 94 and 96 are preferably identical in construction and are connectable together in a stacked relationship. Although three pump modules are shown, it will be understood that more or less modules can be provided, such as a single pump module 92 as shown in FIGS. 5 and 6, or four pump modules 92, 94, 96, and 114 as shown in FIG. 14. Thus, the pump assembly 14 can be constructed with one or more pump modules in a relatively quick and easy manner to meet the particular needs and/or budgetary limitations of the end user.

Each pump module includes a module housing 120 that is preferably box-shaped with a front portion 122, a rear portion 124, an upper portion 126 and a lower portion 128 extending between the front and rear portions, and side portions 130, 132 extending between the front, rear, upper, and lower portions. A crankshaft 134 extends between the front portion 122 and rear portion 124 and is mounted for rotation with respect to the front and rear portions through a front bearing 136 mounted in the front portion 122 and a rear bearing 138 mounted in the rear portion 124. The crankshaft 134 includes a forward shaft portion 140 and a rearward shaft portion 142 with a cylindrical depression 144. The cylindrical depression 144 is sized to receive the forward shaft portion 140 of an adjacent pump module, as shown in FIG. 4. Preferably, the forward shaft portion 140 has external splines which mate with internal splines formed in the depression 144. In this manner, rotation of the crankshaft 134 in the module 92 causes corresponding crankshaft rotation in the other modules, such as the modules 94 and 96.

A front cam 146 and a rear cam 148 are eccentrically mounted on the crankshaft 134 between the forward shaft portion 140 and the rearward shaft portion 142. An upper piston 152 and a lower piston 154 are in contact with a front bearing sleeve 150 associated with the front cam 146, while an upper piston 156 and a lower piston 158 are in contact with a rear bearing sleeve 160 associated with the rear cam 148. Preferably roller bearings 165 (FIG. 7) are located between the bearing sleeves 150, 160 and their respective cams 146, 148. With this arrangement, wear of the cams and/or pistons, as well as the generation of heat due to friction, are substantially reduced than if the cams were in direct rotational contact with the pistons.

Upper and lower piston sleeves 162 and 164 are fixedly secured in the pump module housing 120 between the front portion 122 and center columns 170 and 172, respectively. Likewise, upper and lower piston sleeves 166 and 168 are fixedly secured in the pump module housing 120 between the rear portion 124 and center columns 170 and 172, respectively. Each of the upper and lower piston sleeves has a piston bore 174 and 176, respectively, that is sized for receiving one of the pistons. The upper piston bores 174 of the upper piston sleeves 162, 166 are in fluid communication with an upper longitudinally extending fluid suction conduit 180. Likewise, the lower piston bores 176 of the lower piston sleeves 164, 168 are in fluid communication with a lower longitudinally extending fluid suction conduit 182. The fluid suction conduits 180 and 182 preferably extend along the length of each module and through the front portion 122 and rear portion 124. When two or more modules are connected together, the upper fluid suction conduits 180 are in fluid communication with each other and the lower fluid suction conduits 182 are in fluid communication with each other. In this manner, fluid can be supplied to all of the piston bores from the reservoir 34 (FIG. 1) through the end plate 112 and the hydraulic suction line 38. Plugs 185 are preferably located in the upper and lower portions 126 and 128, respectively, for accessing the internal components of the pump module during assembly and repair.

During rotation of the crankshaft 134, the front and rear cams cause the upper pistons 152, 156 and lower pistons 154, 158 to reciprocate in their respective piston bores 174 and 176 to draw fluid into and push fluid out of the piston bores. When the upper piston 152 is in the retracted position as shown in FIGS. 4 and 5, the lower piston 154 is in the extended position. At the same time, the upper piston 156 is in the extended position and the lower piston 158 is in the retracted position. In this manner, the forces on the camshaft are more evenly distributed than, for example, if the upper pistons 152 and 156 were to move simultaneously toward the extended and retracted positions.

Figure 7:
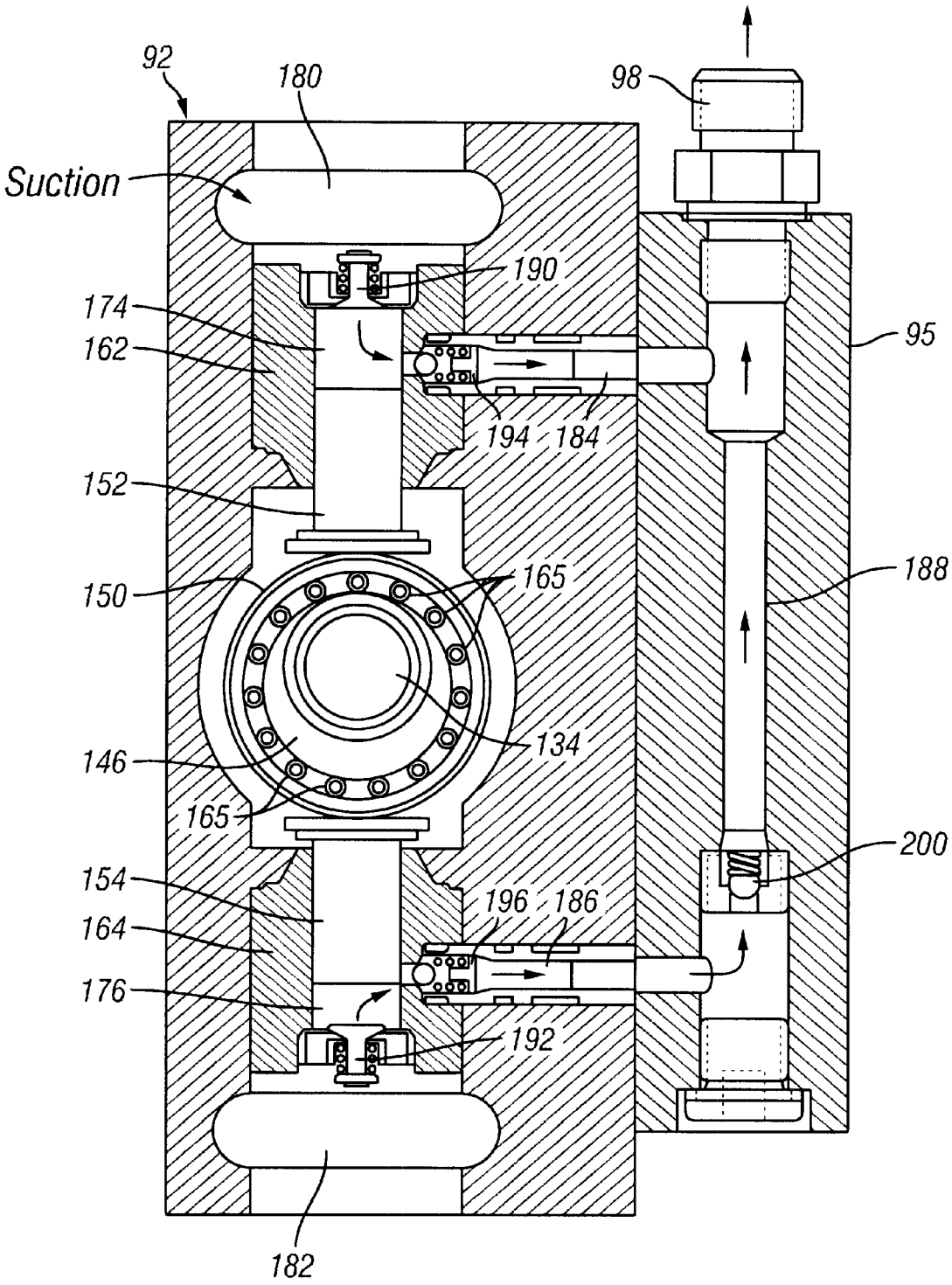
FIG. 7 is a front sectional view of the hydraulic pump assembly taken along line 7—7 of FIG. 5.

As best shown in FIG. 7, the construction and operation of the upper and lower pistons 152 and 154 together with their related components will now be described, it being understood that the upper and lower pistons 156 and 158 and their related components are similar in construction and operation. As the upper piston 152 moves toward the retracted position, a vacuum force is created which draws hydraulic fluid into the upper piston bore 174 of the upper piston sleeve 162 from the upper fluid suction conduit 180. Simultaneously, the lower piston 154 moves toward the extended position to force hydraulic fluid from the lower piston bore 176 of the lower piston sleeve 164 and into a lower transverse bore 186. The hydraulic fluid in turn flows through a first fluid supply conduit 188 formed in the pressure plate 95 and out the hydraulic fitting 98 where it is directed to the manifold assembly 16 (FIG. 1). Conversely, as the upper piston moves toward the extended position, hydraulic fluid from the upper piston bore 174 of the upper piston sleeve 162 is forced into an upper transverse bore 184. The hydraulic fluid in turn flows through the first fluid supply conduit 188 of the pressure plate 95 and is discharged to the manifold assembly 16. Simultaneously, the lower piston 154 moves toward the retracted position, thereby creating a vacuum force which draws hydraulic fluid into the lower piston bore 176 of the lower piston sleeve 164 from the lower fluid suction conduit 182.

Upper and lower fluid suction check valves 190 and 192 are positioned in the upper and lower piston bores 174 and 176, respectively, to permit fluid to be drawn into the piston bores from the fluid suction conduits 180, 182, yet prevent fluid discharge from the piston bores back into the fluid suction conduits. Upper and lower fluid supply check valves 194 and 196 are positioned in the upper and lower transverse bores 184 and 186, respectively, to permit fluid to be discharged into the upper and lower transverse bores, yet prevent fluid from entering the piston bores from the transverse bores. This arrangement is especially important since the upper and lower piston bores alternately cycle between vacuum and pressure modes during operation. The check valves are preferably of conventional construction and operation, and therefore will not be further described.

Figure 8:
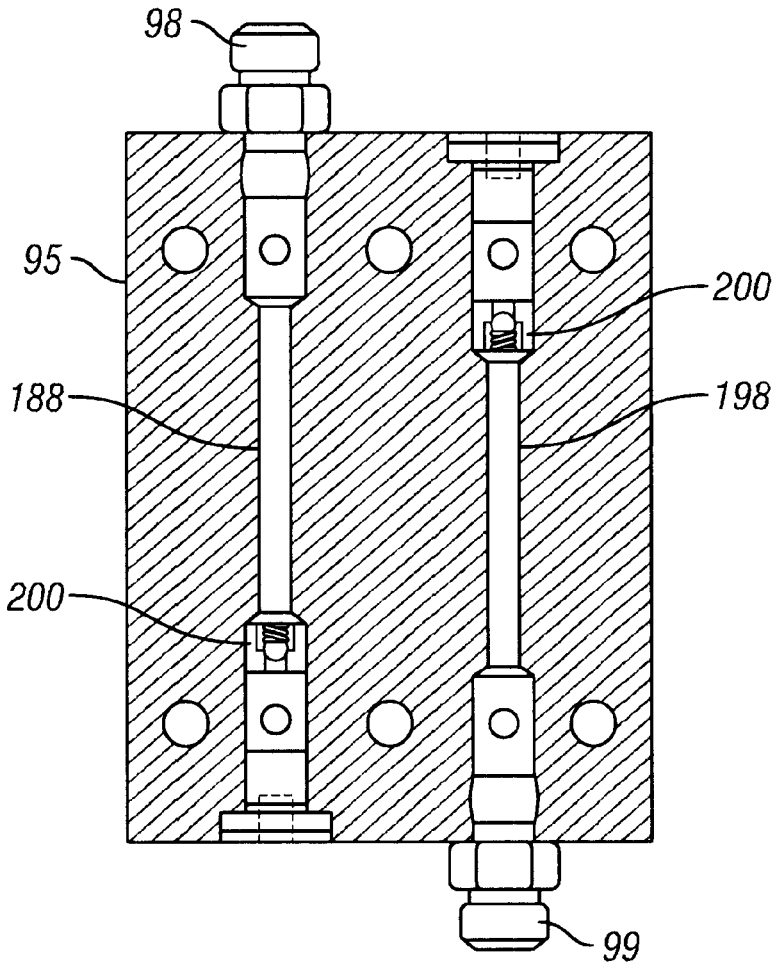
FIG. 8 is a side sectional view of a pressure plate that forms part of the hydraulic pump assembly.
Figure 9:
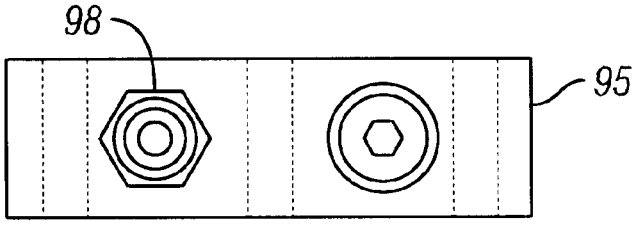
FIG. 9 is a top elevational view of the pressure plate of FIG. 8.

As shown in FIG. 8, the pressure plate 95 includes a corresponding second fluid supply conduit 198 that is in fluid communication with the upper and lower piston bores 174 and 176 of the upper and lower piston sleeves 166 and 168 in the same manner as described with respect to the first fluid supply conduit 188. A check valve 200 is preferably positioned in each of the first and second fluid supply conduits 188 and 198 distal from their respective hydraulic fittings 98, 99. The check valves 200 assure that the hydraulic fluid will travel in the first and second fluid supply conduits only in the direction toward their respective hydraulic fittings. The check valves 200 are also preferably of conventional construction and operation, and therefore will not be further described.

With the arrangement as shown and described, each pump module is capable of generating sufficient pressure to drive the hydraulic emergency tools, which is typically in the range of 5,000 to 10,000 psi. It will be understood that the supplied pressure and/or fluid flow rate can be higher or lower than the typical range, depending on the particular requirements of the emergency tools. In addition, one pump module may be configured to provide hydraulic pressure at a predetermined pressure and/or flow rate, while other pump modules may be configured to provide hydraulic pressure at different pressures and/or flow rates. Thus, it is contemplated that the modules can be mixed and matched to accommodate a wide variety of emergency tool types and their particular requirements.

Referring to FIGS. 4–6, the PTO adapter 110 preferably includes a rear mounting bracket 210 and a front mounting plate 212. The rear mounting bracket 210 preferably has a flange portion 214 that is mounted to the front portion 122 of the pump module 92 through suitable threaded fasteners (not shown), and a hollow cylindrical portion 216 that is connected to the front mounting plate 212 through suitable threaded fasteners (not shown). The front mounting plate 212 is in turn mounted to the drive housing 100 (FIGS. 2 and 3). The front mounting plate 212 together with the hollow cylindrical portion 216 form a bore 218 in which a drive shaft 220 is rotatably mounted through a front bearing 222 and a rear bearing 224. The drive shaft 220 has a splined front shaft portion 226 that preferably meshes with the reduction gear assembly 102 (FIGS. 2 and 3) for rotating the drive shaft when the vehicle's PTO unit is engaged. A depression 228 is preferably formed in the rear end of the drive shaft 220 and is sized to receive the forward shaft portion 140 of an adjacent pump module. Preferably, internal splines (not shown) are formed in the depression 228 for mating with the external splines of the shaft portion 140 so that rotation of the drive shaft causes rotation of the crankshaft 134, and thus operation of the or each pump module. As shown, a shaft seal 230 can be provided for sealing the shaft 220 and bearings 222, 224 against outside contaminants. A seal, shown here in the form of an O-ring 226, can also be positioned between the PTO adapter 110 and the pump module 92, between the pump modules themselves, and between the end plate 112 and the rear pump module.

The end plate 112 includes an upper fluid suction port 240 that is in fluid communication with the upper fluid suction conduit 180, and a lower fluid suction port 242 that is in fluid communication with the lower fluid suction conduit 182.

The upper and lower fluid suction ports are in turn connected to the hydraulic suction line 38 (FIG. 1) through hydraulic fittings (not shown).

With reference now to FIGS. 10–13, the manifold assembly 16 has a plurality of manifold modules, preferably corresponding in number to the pump modules. For a pump assembly 14 having three pump modules, the manifold assembly 16 preferably has three manifold modules 250, 252, and 254 as shown. The manifold modules are preferably identical in construction and each preferably includes a fluid transfer block 256, a pair of solenoid valves 258 and 260 and safety relief valves 262 that are mounted to the fluid transfer block. As shown, the manifold modules 250, 252 and 254 are connectable together in a stacked relationship and are sandwiched between an end plate 264 and a discharge plate 266. The manifold modules, end plate and discharge plate are connected together by fasteners (not shown), such as threaded bolts, that extend through aligned mounting bores 268, 270, 272, and 274 formed in each fluid transfer block and the discharge plate 266, and into corresponding fastening bores, only two of which are shown in hidden line in FIG. 10 and designated by numerals 276 and 278. Preferably, the corresponding fastening bores are threaded to mate with threads on the bolts to thereby secure the manifold modules and plates together. When it is desired to increase or decrease the number of manifold modules, only the length of the threaded bolts need be changed.

Figure 11:
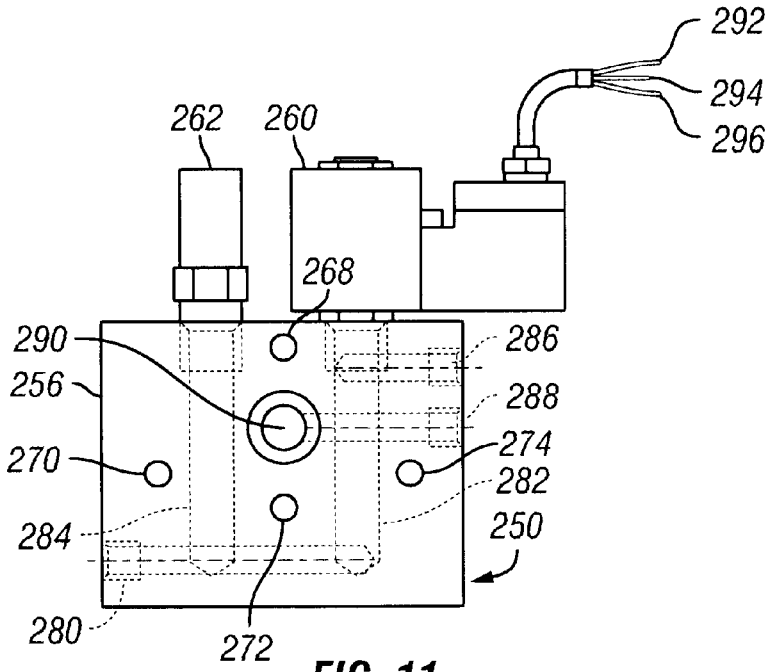
FIG. 11 is a rear elevational view of a manifold module that forms part of the manifold assembly of FIG. 10.

Each manifold module preferably includes a pair of separate, yet substantially identical fluid circuits 279 for supplying hydraulic fluid to, and receiving hydraulic fluid from, two separate emergency rescue tools. Accordingly, only one fluid circuit for a single emergency rescue tool will be described. As shown most clearly in FIG. 11, each fluid circuit includes a first fluid supply bore 280 (shown in hidden line) that is in fluid communication with a valve bore 282 (shown in hidden line) and a safety relief bore 284 (shown in hidden line). The safety relief valve 262 extends into the safety relief bore 284 and is adapted to open when pressure in the safety relief bore is above a predetermined level. Although only one safety relief valve is shown in FIG. 11, it is preferable that a separate safety relief valve be provided for each fluid supply bore 280 in each manifold module. The fluid supply bore 280 receives pressurized hydraulic fluid from one of the first and second fluid supply conduits 188 and 198 associated with one of the pump modules 92, 94, or 96. Although not shown, the fluid supply bore of the second fluid circuit can receive hydraulic fluid under pressure from the other of the first and second supply conduits 188 and 198 associated with one of the pump modules. It will be understood, however, that any of the fluid circuits 279 of the manifold assembly can be connected to any of the supply conduits of the pump assembly.

A second fluid supply bore 286 (shown in hidden line) is fluidly connected to the valve bore 282 for delivering the pressurized hydraulic fluid to the emergency rescue tool when the solenoid valve is in the activated position. A first fluid return bore 288 (shown in hidden line) receives the hydraulic fluid from the emergency rescue tool and is fluidly connected to a second or common fluid return bore 290 that preferably extends transverse to the first fluid return bore. The common fluid return bore 290 is preferably in alignment with the common fluid return bores of the other manifold modules and in fluid communication with the fluid cooler 30 (FIG. 1) so that the return hydraulic fluid from all of the modules is discharged into the fluid cooler. The valve bore 274 is also fluidly connected to the common fluid return bore 90 when the solenoid valve is in its normally deactivated position.

The solenoid valve 260 extends into the valve bore 282 for selectively directing pressurized hydraulic fluid from the first fluid supply bore 280 to either the second fluid supply bore 286 or to the common fluid return bore 290, depending on the actuation state of the solenoid valve. Electrical wires 292, 294 and 296 are provided on the solenoid valve 260 for connection to positive voltage, ground, and a remote switch (not shown) associated with the emergency rescue tool.

Figure 12:
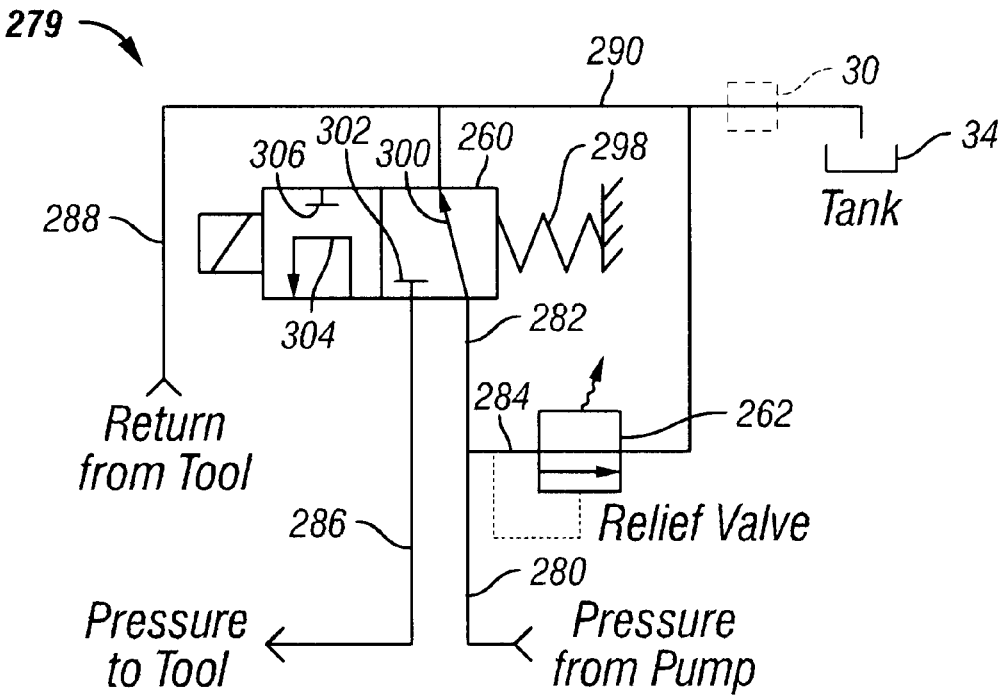
FIG. 12 is a schematic representation of a fluid circuit of the manifold module in a rest or non-use position.
Figure 13:
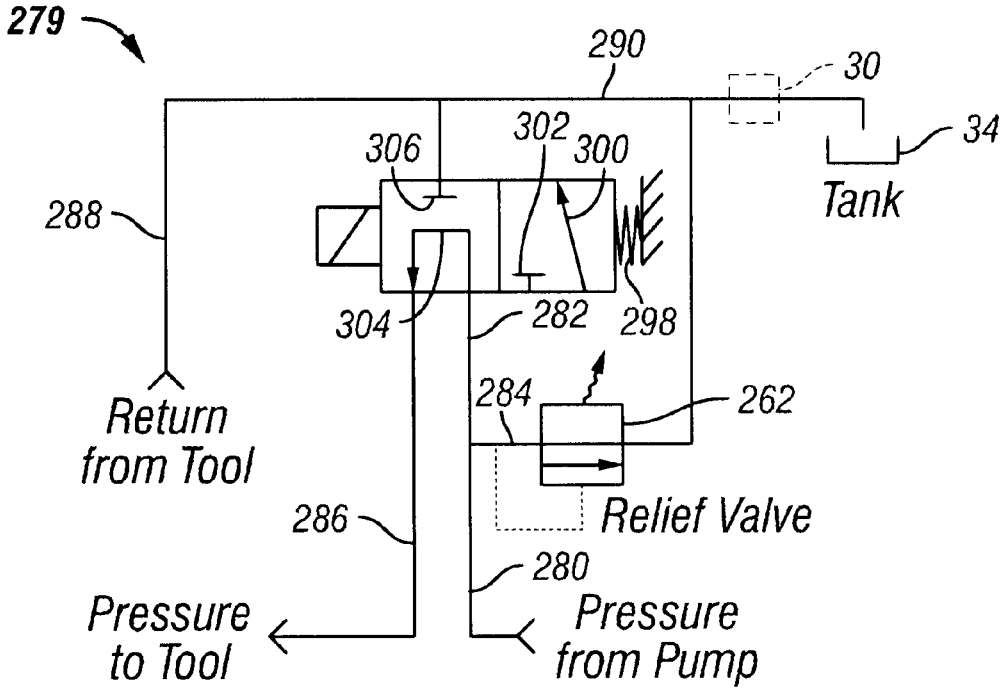
FIG. 13 is a schematic representation of the fluid circuit of the manifold module during use.

With particular reference now to FIGS. 12 and 13, operation of the hydraulic circuit 279 will now be described, it being understood that the hydraulic circuits in all of the modules operate in the same manner. As shown in FIG. 12, the solenoid valve 260 is normally biased in a rest or fluid return position by a spring 298, such that a fluid return conduit 300 is in alignment with the first fluid supply bore 280 and the fluid return bore 290, and a fluid blocking port 302 is in alignment with the second fluid supply bore 286. In this position, the hydraulic fluid from the pump is returned to the fluid cooler 30 and the fluid reservoir 34. This is especially advantageous since an emergency tool or hose reel need not be connected to the fluid circuit during operation of the hydraulic rescue system 10.

When the solenoid valve 260 is actuated, such as by pressing a switch on the emergency rescue tool, the solenoid valve moves to the activated position, as shown in FIG. 13, against bias from the spring 298. In the activated position, a fluid supply conduit 304 is in alignment with the first fluid supply bore 280 and the second fluid supply bore 286, and a fluid blocking port 306 is in alignment with the fluid return bore 290. In this position, the hydraulic fluid from the pump assembly is directed to the emergency rescue tool before it is returned to the fluid cooler 30 and the fluid reservoir 34.

The provision of separate solenoid valves in the manifold and separate supply and return lines for each emergency rescue tool permits one or more emergency rescue tools to be connected and disconnected without affecting operation of the other rescue tools. Thus, as little as one rescue tool may be connected, or as many as needed depending on the number of pump and manifold modules provided.

As shown in FIG. 1, an indicator display 310 can be provided with indicator lights 312, 314, and 316 for alerting the end user when the hydraulic rescue system 10 is not operating normally, when there is a high temperature hydraulic fluid condition, and when there is a low hydraulic fluid level.

With reference now to FIG. 14, a hydraulic rescue system 10A according to a further embodiment of the invention is illustrated, wherein like parts in the previous embodiment are represented by like numerals. The hydraulic rescue system 10A is substantially similar in construction to the hydraulic rescue system 10 previously described, with the exception that an additional pump module 114 is provided on the pump assembly 14A and an additional manifold module 320 is provided on the manifold assembly 16A. Fluid supply lines 322 and 324 extend between the pump module 14A and the manifold modules 252 and 254, respectively. It will be understood that the fluid supply lines 18–28, 322, and 324 need not be connected as shown, but may extend between any pump module and any manifold module. With this arrangement, a total of eight tools can be independently operated without affecting the operation of other tools.

Figure 15:
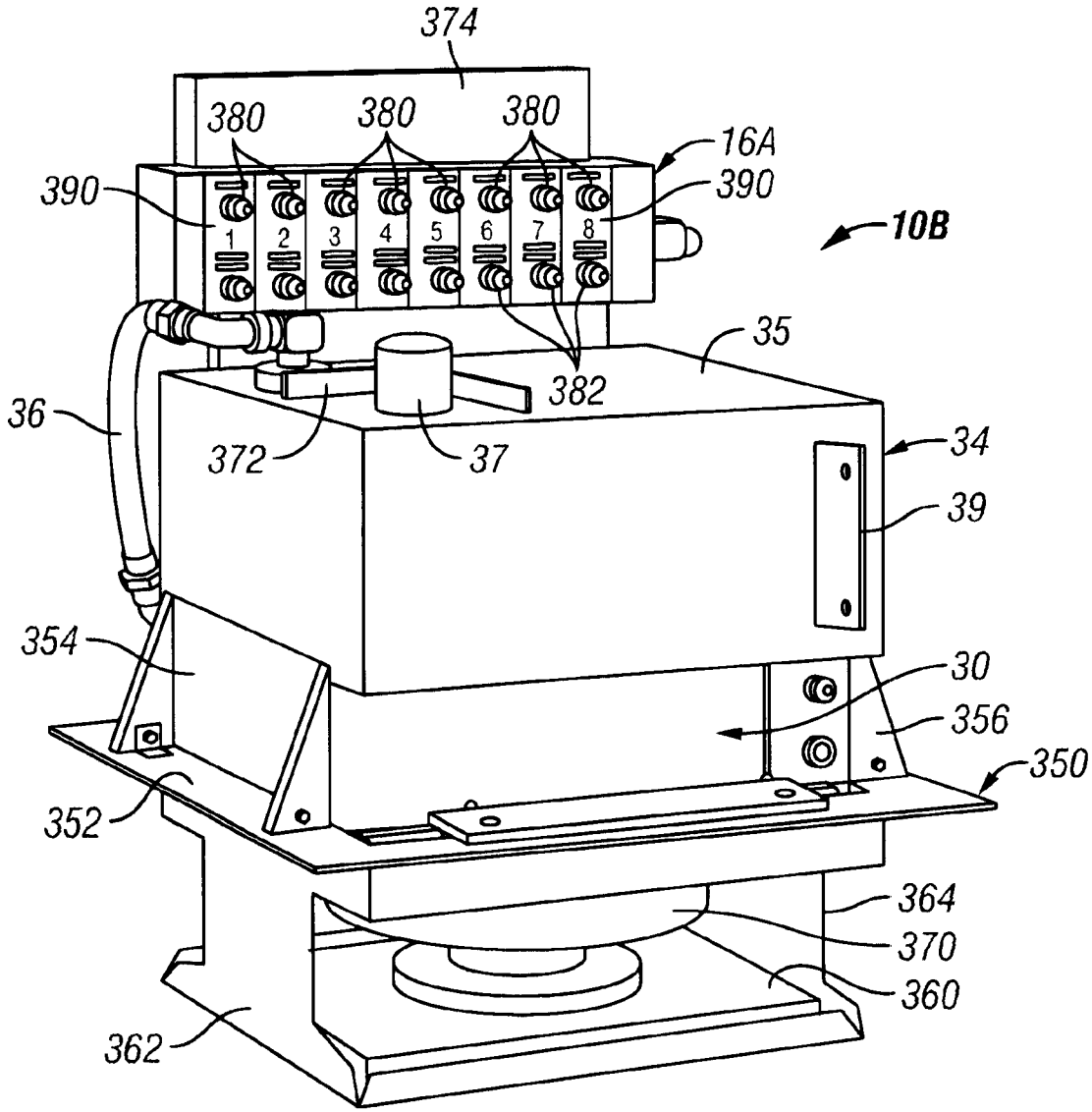
FIG. 15 is a front isometric view of a hydraulic rescue system in accordance with an even further embodiment of the invention.
Figure 16:
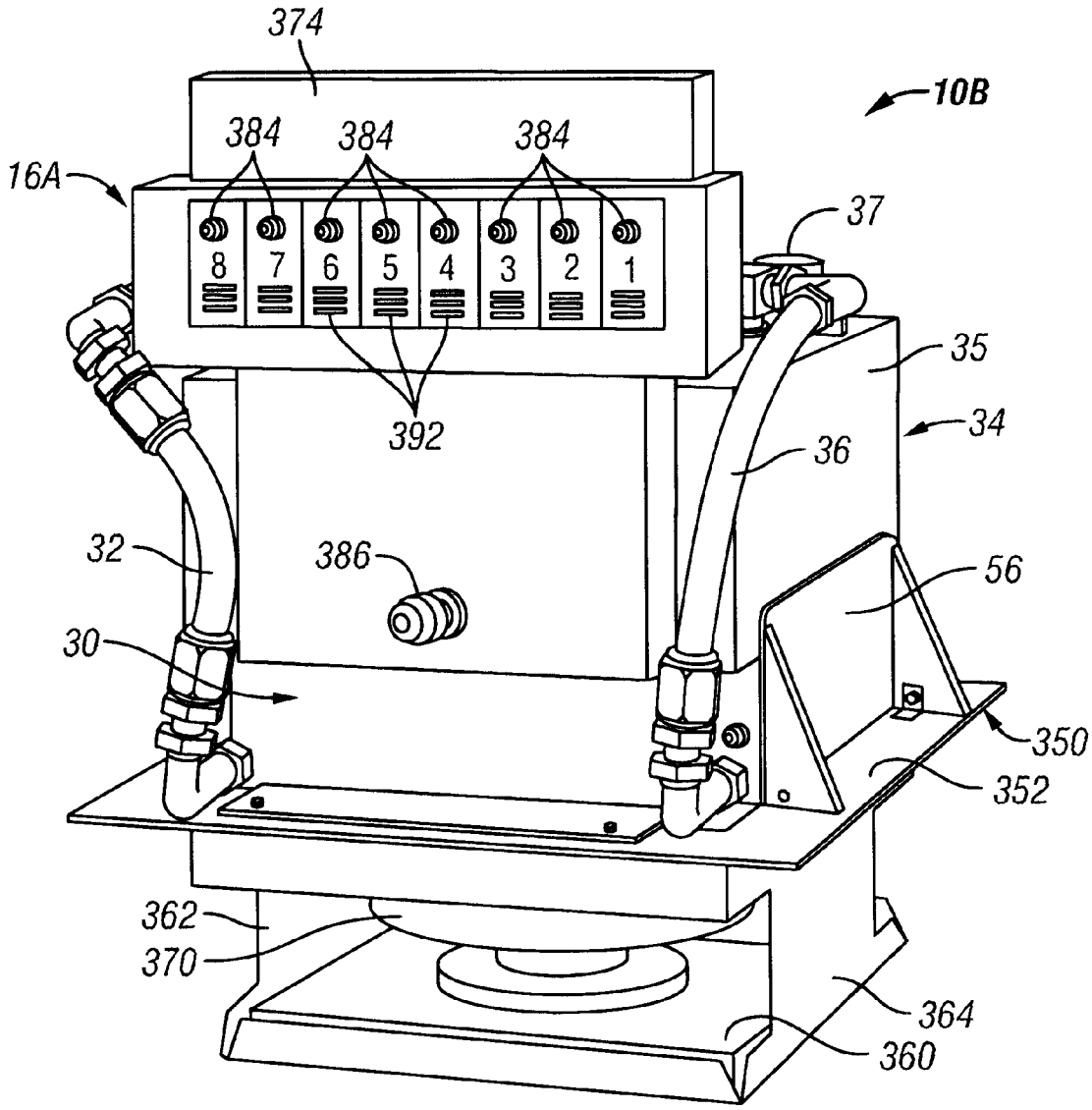
FIG. 16 is a rear isometric view of the hydraulic rescue system of FIG. 14.

With reference now to FIGS. 15 and 16, a hydraulic rescue system 10B according to a further embodiment of the invention is illustrated, wherein like parts in the previous embodiments are represented by like numerals. The hydraulic rescue system 10B is substantially similar in construction to the hydraulic rescue system 10A previously described, with the exception that the manifold assembly 16A, the fluid cooler 30, and the fluid reservoir 34 are mounted on a frame 350 for installation as a single unit on a vehicle.

The frame 350 includes a mounting plate 352 that extends around the fluid cooler 30, a pair of support plates 354 and 356 that extend upwardly from the mounting plate 352, and a skid plate 360 that is spaced from the mounting plate 352 by a pair of skid plate supports 362 and 364 that extend between the mounting plate and the skid plate. A fan unit 370 is preferably supported on the frame 350 and is oriented for directing air over the coils (not shown) of the fluid cooler 30. The mounting plate 352 is preferably supported on a floor other support surface (not shown) of a vehicle with the skid plate located below the support surface. The mounting plate can be secured to the support surface through suitable fasteners, welding, or the like. Alternatively, the skid plate 360 can be directly mounted to a support surface of the vehicle.

Figure 10:
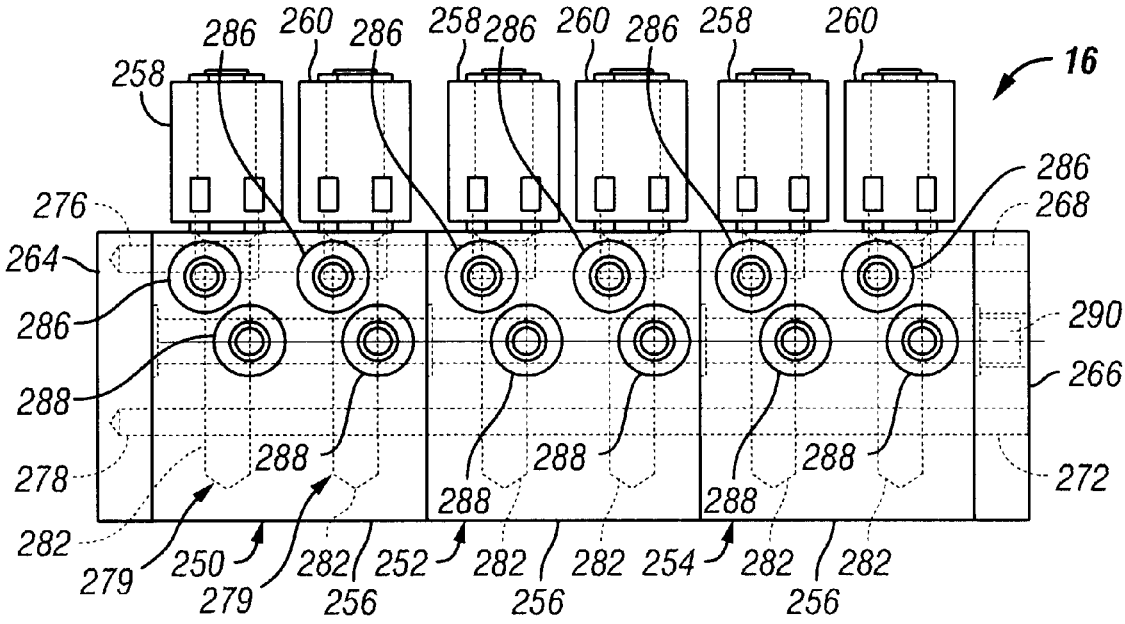
FIG. 10 is a front elevational view of a manifold assembly in accordance with the present invention that forms part of the hydraulic rescue system of FIG. 1.

As shown in FIG. 15, an L-shaped wall 372 is positioned on the tank 35 adjacent the fill cap 37 to prevent the hydraulic fluid from spreading across the top of the tank in the event of a spill, since some hydraulic fluids are detrimental to surface finishes. The manifold block may include a cover 374 that encloses the solenoid valves 258, 260 (FIG. 10).

A plurality of hydraulic supply connectors 380 are associated with each of the second fluid supply bores 286 (FIG. 10) of the manifold assembly 16A. Likewise, a plurality of hydraulic return connectors 382 are associated with each of the first fluid return bores 288 (FIG. 10) of the manifold assembly 16A. The hydraulic supply and return connectors are preferably connected to an equal number of hydraulic dual feed/return lines for connection with different hose reels and/or different hydraulic rescue tools. A plurality of hydraulic supply connectors 384 (FIG. 16) are associated with each of the first fluid supply bores 280 (FIG. 10) of the manifold assembly 16A for connection with an equal number of fluid supply lines 18–28, 322, and 324 (FIG. 14). A main hydraulic return connector 386 is associated with the fluid reservoir 34 for connection to the hydraulic suction line 38 (FIG. 14) so that hydraulic fluid from the reservoir can be returned the pump assembly 14A (FIG. 10). A label 390 is associated with each pair of connectors 380, 382 so that the hose reels and/or hydraulic rescue tools can be properly connected. Likewise, a label 392 is associated with each of the hydraulic supply connectors 384.

Operation of the hydraulic rescue system 10B is substantially similar to the hydraulic rescue systems 10 and 10A, and therefore will not be further described.

It will be understood that the terms front, rear, upper, lower, and their respective derivatives, as well as other terms of orientation and/or position as may be used throughout the specification refer to relative, rather than absolute orientations and/or positions.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A hydraulic rescue system for a vehicle having a transmission with a PTO shaft, the hydraulic rescue system comprising:

a fluid reservoir;

a pump assembly fluidly connected to the fluid reservoir, the pump assembly having:

at least one pump module with an input port for drawing hydraulic fluid from the fluid reservoir and at least one output port for supplying hydraulic fluid under pressure to at least one hydraulic rescue tool; and a PTO adapter operably connected to the at least one pump module, the PTO adapter being operably connectable to the PTO shaft of the vehicle transmission for operating the at least one pump module.

2. A hydraulic rescue system according to claim 1, wherein the at least one pump module comprises a plurality of output ports for supplying hydraulic fluid under pressure to a plurality of hydraulic rescue tools.

3. A hydraulic rescue system according to claim 1, wherein the pump assembly comprises a plurality of pump modules that are operably connected together for supplying hydraulic fluid under pressure to a plurality of hydraulic rescue tools.

4. A hydraulic rescue system according to claim 3, wherein each pump module comprises a plurality of output ports for supplying hydraulic fluid under pressure to a plurality of hydraulic rescue tools.

5. A hydraulic rescue system according to claim 1, and further comprising a manifold assembly having at least one manifold module with at least one fluid circuit that is adapted to fluidly connect the at least one output port with the at least one hydraulic rescue tool.

6. A hydraulic rescue system according to claim 5, wherein the manifold assembly and the fluid reservoir are mounted on a support frame that is adapted for installation on a support surface of the vehicle.

7. A hydraulic rescue system according to claim 5, and further comprising a valve located in the fluid circuit, the valve being movable to a first position to direct the hydraulic fluid under pressure from the at least one output port to the at least one hydraulic rescue tool when the at least one hydraulic rescue tool is in operation.

8. A hydraulic rescue system according to claim 7, wherein the at least one manifold module is fluidly connected to the fluid reservoir, and further wherein the at least one valve is movable to a second position to direct the hydraulic fluid from the at least one output port to the fluid reservoir when the at least one hydraulic rescue tool is inactive.

9. A hydraulic rescue system according to claim 7, wherein the at least one valve is a solenoid valve that is responsive to an electrical signal from the at least one rescue tool.

10. A hydraulic rescue system according to claim 5, wherein the manifold assembly comprises a plurality of manifold modules for directing the hydraulic fluid to a plurality of hydraulic rescue tools and the fluid reservoir.

11. A hydraulic rescue system according to claim 10, wherein the plurality of manifold modules are connected together in a stacked relationship.

12. A hydraulic rescue system according to claim 11, wherein the plurality of pump modules are connected together in a stacked relationship.

13. A hydraulic rescue system according to claim 5, and further comprising a fluid cooler fluidly connected between the manifold assembly and the fluid reservoir.

14. A hydraulic rescue system according to claim 13, wherein the manifold assembly, the fluid cooler and the fluid reservoir are mounted on a support frame that is adapted for installation on a support surface of the vehicle.

15. A hydraulic rescue system comprising:

a fluid reservoir;

a pump assembly having a plurality of pump modules, each pump module including an input port for drawing hydraulic fluid from the fluid reservoir and a first output port for supplying hydraulic fluid under pressure to a hydraulic rescue tool; and a manifold assembly having a corresponding number of manifold modules, each manifold module including a first fluid circuit that is adapted to fluidly connect the first output port of one of the pump modules with a hydraulic rescue tool.

16. A hydraulic rescue system according to claim 15, wherein each pump module includes a second output port for supplying hydraulic fluid under pressure to a hydraulic rescue tool, and each manifold module includes a second fluid circuit that is adapted to fluidly connect the second output port of one of the pump modules with a hydraulic rescue tool.

17. A hydraulic rescue system according to claim 16, and further comprising a valve located in each fluid circuit, each valve being movable to a first position to direct the hydraulic fluid under pressure from one of the first and second one output ports to a hydraulic rescue tool when the hydraulic rescue tool is in operation.

18. A hydraulic rescue system according to claim 17, wherein the manifold modules are fluidly connected to the fluid reservoir, and further wherein each valve is movable in its respective fluid circuit to a second position to direct the hydraulic fluid from the one output port to the fluid reservoir when the hydraulic rescue tool is inactive.

19. A hydraulic rescue system according to claim 18, wherein each valve is a solenoid valve that is responsive to an electrical signal from a hydraulic rescue tool.

20. A hydraulic rescue system according to claim 15, wherein the plurality of pump modules are connected together in a stacked relationship.

21. A hydraulic rescue system according to claim 20, wherein the plurality of manifold modules are connected together in a stacked relationship.

22. A hydraulic rescue system according to claim 15, wherein the plurality of manifold modules are connected together in a stacked relationship.

23. A hydraulic rescue system according to claim 15, and further comprising a PTO adapter operably connected to the pump assembly, the PTO adapter being operably connectable to a PTO shaft of a vehicle transmission for operating the plurality of pump modules.

24. A hydraulic rescue system comprising:

a fluid reservoir;

a pump assembly having at least one pump module with an input port for drawing hydraulic fluid from the fluid reservoir and an output port for supplying hydraulic fluid under pressure to a hydraulic rescue tool; and a manifold assembly comprising:

at least one manifold module with a fluid circuit that is adapted to fluidly connect the output port of the pump module with a hydraulic rescue tool; and a valve located in the fluid circuit, the valve being movable to a first position to direct the hydraulic fluid under pressure from the output port to the hydraulic rescue tool when the at least one hydraulic rescue tool is in operation, the valve being movable to a second position to direct the hydraulic fluid from the at least one output port to the fluid reservoir when the hydraulic rescue tool is inactive.

25. A hydraulic rescue system according to claim 24, wherein the valve is a solenoid valve that is responsive to an electrical signal from a hydraulic rescue tool.

* * * * *